United States Patent [19]

Stahl

[11] 4,044,879

[45] Aug. 30, 1977

[54] ARRANGEMENT FOR RECORDING CHARACTERS USING MOSAIC RECORDING MECHANISMS

[75] Inventor: Horst Stahl, Weidach, Germany

[73] Assignee: Siemens Aktiengesellschaft, Berlin & Munich, Germany

[21] Appl. No.: 654,642

[22] Filed: Feb. 2, 1976

[30] Foreign Application Priority Data

Mar. 7, 1975 Germany ..... 2510044

[51] Int. Cl.[2] ..... B41J 3/04

[52] U.S. Cl. ..... 197/1 R; 178/30

[58] Field of Search ..... 197/1 R; 178/23, 26, 178/30; 101/93.04, 93.05; 340/324 AD

[56] References Cited

U.S. PATENT DOCUMENTS

| | | | |
|---|---|---|---|
| 3,759,359 | 9/1973 | Stellmach | 197/1 R |
| 3,878,536 | 4/1975 | Gilliam | 178/30 X |
| 3,893,100 | 7/1975 | Stein | 178/30 X |
| 3,893,558 | 7/1975 | Fulton et al. | 197/1 R |

*Primary Examiner*—Ralph T. Rader

*Attorney, Agent, or Firm*—Hill, Gross, Simpson, Van Santen, Steadman, Chiara & Simpson

[57] ABSTRACT

A device for recording characters on a recording carrier uses mosaic recording mechanisms. In addition to the recording of the characters in the required character height, additional recording members are arranged in the recording head and a control device for the mosaic recording mechanism is constructed in an expanded manner so that alternately a height-extended character formation can be executed over all recording members. The device is suitable for recording capital and small letters, and the control apparatus is constructed so that all alternatively the capital letters and numerals can be recorded in an extended manner by an additional amount provided for the short heights of the small letters. The control apparatus for each of the two character heights to be formed by the mosaic recording head has its own character generator and switching means are provided so that the two character generators can be alternately effective for activating the mosaic recording head.

6 Claims, 2 Drawing Figures

BUY FOUR GOOD FURS EACH WEEK 1234567890
BUY FOUR GOOD FURS EACH WEEK 1234567890
BUY FOUR GOOD FURS EACH WEEK 1234567890

ARRANGEMENT FOR RECORDING CHARACTERS USING MOSAIC RECORDING MECHANISMS

BACKGROUND OF THE INVENTION

1. Field of the Invention

This invention relates to an arrangement for recording characters on a recording carrier using mosaic recording mechanisms, and in particular to such an arrangement in which selected characters may be recorded at an extended height.

2. Description of the Prior Art

In utilizing mosaic recording mechanisms, the individual characters are formed by character elements applied by the mosaic writing head in a dot form parallel to one another and/or one after the other onto the recording carrier. For the recording of capital characters and numbers, various patterns have become known, within which the recording of the individual elements occurs. If it is desired that small letters, such as lower case letters, are also to be recorded, then an additional pattern area is provided for so-called short lengths of these symbols.

It is frequently desirable to emphasize certain sections of a text or numerical values of a text vis-a-vis the remaining text. In printing technology this desire can be met in that the symbols are reproduced by wider, larger or thicker type-set or by cursive script. These solutions are either not feasible, or at least not satisfactory, in the use of mosaic printing, since, among other things, the desired effect of emphasizing the certain symbols vis-a-vis the remaining text is only partial, and the type character of these symbols suffers from this measure.

SUMMARY OF THE INVENTION

It is therefore the primary object of the present invention to provide an arrangement with which certain terms, text sections and numerical values can be clearly emphasized vis-a-vis the remaining text sections without a lessening of the type quality.

An arrangement which fully meets these requirements is characterized in that, in addition to the recording elements necessary for the recording of characters in a desired character height, additional recording elements are arranged in the mosaic recording head, and a control device for the mosaic recording mechanism is constructed in an expanded form such that alternately a height-extended character formation may be executed over all of the recording elements.

Mosaic recording mechanisms, with the help of which, in addition to capital letters, small letters can also be printed, already contain an increased number of recording elements, since the possibility of recording the short lengths of the small letters must also be present. With such mosaic recording mechanisms, the present invention extends the development thereof to the effect that the control device for the mosaic recording mechanism is designed in an expanded form such that the capital letters and numbers are alternatively extendable by an amount provided for the short lengths of the small letters. Text portions, which would be correspondingly marked, are, in this case, to be written in enlarged capital letters.

Through the alternative alteration of the characters in respect of their height, an easily recognizable emphasis of the corresponding characters vis-a-vis the remaining text comes about, without the readability and script quality being impaired in any fashion. With mosaic recording mechanisms in which additional elements are, in any case, provided in the writing head for the recording of short lengths of small letters, the additionally required expenditure is not particularly great, since corresponding symbol generators can be produced and supplied in integrated circuit construction technology.

According to a preferred further development of the invention, the control device for each of the two character heights to be formed by the mosaic writing head has its own character generator and, via switching means, one of the two character generators can alternatively be activated for controlling the mosaic writing head.

In addition to the above step, it is possible to organize an individual character generator in such a manner that, in each case, in dependence on a shift criterion by this generator, characters of varying character height can be recorded.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figures 1, 2:
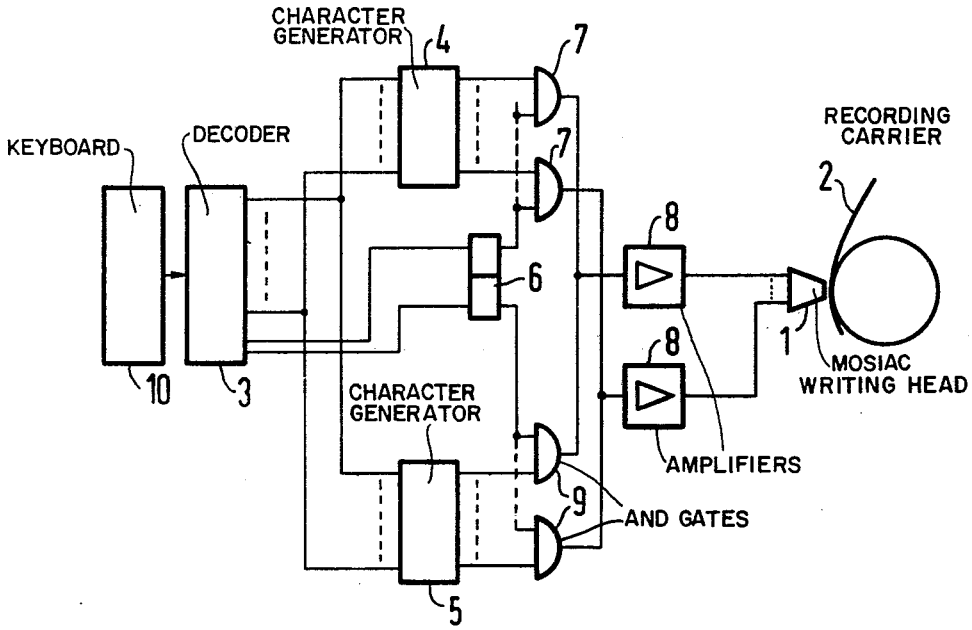
FIG. 1 is a schematic representation of an arrangement for writing various sized characters using a mosaic writing head.
FIG. 2 is an exemplary showing of text in which individual words are emphasized by enlargement of the character height.

Referring to FIGS. 1 and 2, a mosaic writing head 1, with the help of which the information characters are to be recorded on a recording carrier 2, contains twelve recording members. These twelve recording members, each of which are well known in the art, produce all character dots which are necessary for the total writing height. By advancing the mosaic writing head in the line direction and simultaneously triggering the individual recording members, the individual characters are formed. For capital letters and numerals the upper nine recording elements are required, whereas the three recording elements positioned thereunder find use additionally in the formation of short lengths for small letters.

Binary coded information characters are provided from the keyboard 10 or a telegraph channel or a perforated tape equipment and are decoded in a decoder 3 and fed, in parallel, to a pair of character generators 4 and 5. The character generators 4 and 5 form the character patterns in which the mosaic writing head 1 is to be triggered. The character generator 4 serves to generate characters in a normal script, whereas the character generator 5 is designed in such a way that capital letters and numerals are formed which extend in height over all nine available character elements. The character width is the same in each case.

If the printing is to be done in normal script, then a bistable flip-flop 6 is set in such a way that control commands offered by the character generator 4 are fed by way of an AND gate 7 and the amplifiers 8 to the mosaic writing head 1. In the meantime, the AND gate 9 is blocked. Of course, on the drawing, the AND gate 7, the AND gate 9 and the amplifier 8 are only representative of a plurality of such devices which are individually available for respective outputs of the character generators 4 and 5.

If a portion of a text is now to be emphasized vis-a-vis the remaining text, then the bistable flip-flop 6 is switched over by a character combination received in the decoder 3, so that the AND gates 7 are blocked and the AND gates 9 are opened for the flow of control commands from the character generator 5, via the amplifiers 8, to the mosaic writing head 1. By means of corresponding triggering of the bistable flip-flop 6, the outputs of the character generator 5 are again blocked by way of the AND gates 9, and the outputs of the character generator 4 are again extended by way of the AND gates 7, so that further information can again be recorded in the normal script by the mosaic writing head 1.

FIG. 2 illustrates a sample text in which the words "week" and "furs" are emphasized by enlargement of the character height. The character width is maintained unchanged. From this exemplary showing of the text, it can be seen that the effect of an emphasis of designated words is clearly expressed. In the present case, the characters are lengthened downwardly by the amount of the short lengths of small letters. For example, by swinging the mosaic writing head 1 upwardly by three element units--that corresponds to the amount of short lengths of the small letters--it is also possible to form the type character in such a way that the enlarged letters are formed extended above the normal text.

Although I have described my invention by reference to particular illustrative embodiments thereof, many changes and modifications of the invention may become apparent to those skilled in the art without departing from the spirit and scope of the invention. I therefore intend to include within the patent warranted hereon, all such changes and modifications as may reasonably and properly be included within the scope of my contribution to the art.

I claim:

1. A device for recording characters on a recording carrier, comprising:

recording means comprising a mosaic recording head including a plurality of first recording members which may be activated to record characters of a first height and a plurality of second recording members which may be activated to extend the recording height to a second height; and recording height control means connected to said recording head and including a signal input, said recording height control means responsive to first input signals to selectively activate said first recording members to record characters of the first height and responsive to alternately received second input signals to selectively activate said first and second recording members to record characters of the second height.

2. The device of claim 1, wherein said recording height control means comprises:

a decoder for receiving and decoding first and second input signals and providing first output signals representing first character signals and first character height signals and second output signals representing second character signals and second character height signals;

first and second character generators connected to receive said first and second character signals and provide corresponding character control signals;

gating means connected to said first and second character generators to receive said character control signals and connected to said recording means; and gate control means connected to said gating means and connected to said decoder to receive said first and second character height signals and open said gating means for the character control signals associated with the received character height signals.

3. The device of claim 2, wherein said gating means comprises a plurality of first AND gates each having an input connected to said first character generator and an output connected to said recording means, and a plurality of second AND gates each having an input connected to said second character generator and an output connected to said recording means, and said gate control means comprises a bistable circuit having inputs connected to said decoder and a pair of oppositely active outputs connected to respective ones of said AND gates.

4. The device of claim 3, wherein said bistable circuit comprises a flip-flop.

5. The device of claim 3, wherein said recording means comprises an amplifier connected between said outputs of said AND gates and said mosaic recording head.

6. The device of claim 1, wherein said first recording members correspond to capital letters, said second recording members corresponds to lower case letters, and said recording height control means comprises means for providing an extended height recording of said capital letters by the height of the lower case letters.

* * * * *